United States Patent [19]

Mizell

[11] 4,159,883

[45] Jul. 3, 1979

[54] CLEANING PAD

[75] Inventor: Louis R. Mizell, Woodbury, N.Y.

[73] Assignee: I.W.S. Nominee Company Limited, London, England

[21] Appl. No.: 816,752

[22] Filed: Jul. 18, 1977

[30] Foreign Application Priority Data

Jul. 22, 1976 [GB] United Kingdom ..... 30665/76

[51] Int. Cl.[2] ..... A47K 5/12

[52] U.S. Cl. ..... 401/201; 401/198; 15/244 C

[58] Field of Search ..... 401/201, 289, 7, 196, 401/291; 15/244 B, 244 C

[56] References Cited

U.S. PATENT DOCUMENTS

| | | | |
|---|---|---|---|
| 691,032 | 1/1902 | Wiens | 401/291 |
| 2,635,273 | 4/1953 | Logan | 401/201 |
| 2,952,026 | 9/1960 | Vosbikian et al. | 401/201 |
| 3,066,347 | 12/1962 | La Pland | 401/28 |
| 3,067,450 | 12/1962 | Mirth | 401/201 |
| 3,080,688 | 3/1963 | Politzer | 51/185 |
| 3,114,928 | 12/1963 | Spiteri | 401/201 |
| 3,556,667 | 1/1971 | Kaufman | 15/118 |
| 3,638,270 | 2/1972 | Schlegel, Jr. et al. | 15/244 B |
| 3,641,610 | 2/1972 | Lewis, Jr. | 15/114 |
| 3,791,746 | 2/1974 | Yearka | 401/201 |

FOREIGN PATENT DOCUMENTS

| | | | |
|---|---|---|---|
| 1282258 | 11/1968 | Fed. Rep. of Germany | 401/201 |
| 596339 | 1/1948 | United Kingdom | 401/201 |
| 1093900 | 12/1967 | United Kingdom | 401/201 |

*Primary Examiner*—William Pieprz

*Attorney, Agent, or Firm*—Harold L. Stowell

[57] ABSTRACT

A cleaning pad with an internal well for cleaning agent consists of at least one surface formed from a tufted textile fabric with the inner ends of the yarns forming the tufts in communication with the cleaning agent in the well, through yarn-containing openings in a plastic film separating the tufted fabric and the well.

8 Claims, 9 Drawing Figures

CLEANING PAD

BACKGROUND OF THE INVENTION

Description of the Prior Art

There are a variety of scouring pads knwon in the art, for example, there are abrasive steel wool pads, consisting of a bundle of metal fibers. Some of those pads are impregnated with soap or with a mixture of soap, detergent, sodium carbonate, perfume and dye. These cleaning ingredients are only on the surface of the steel wool fibers. Thus, when the pads are immersed in water, all or most of the cleaning agent is quickly removed from them into the water. Also, the wet steel wool pads rust and deteriorate within one to two days from the time they are initially used. Consequently, because they quickly lose their cleaning ingredients and rust badly, a steel wool pad can only be used once or twice and thrown away.

Another type of scouring pad known in the art consists of a carded batt of fibers, such as nylon or polyester or rayon or mixture of fibers. The batt is impregnated or sprayed with an adhesive emulsion containing an abrasive material such as silica particles, and dried. The batt of adhesive bonded fibers and abrasive is cut into pads that are about ¼" thick and 4" wide and 6" long. No cleaning agent is applied to the pads except by users. Another form of scouring pad is disclosed in U.S. Pat. No. 3,080,688 and consists of a layer of the adhesive and abrasive treated fiber batt, noted immediately above, laminated to a layer of cellulose sponge which had been impregnated with a detergent solution.

A fourth type of scouring pad is disclosed in U.S. Pat. No. 3,641,610 and consists of a cellulose sponge with tufts of synthetic filaments imbedded in its thickness spaced about ½" apart and extending above one surface of the sponge to serve as scrubbing bristles.

A fifth general type of scouring pad known to the art consists of a polyurethane foam pad ¼" or ½" thick with either an extruded plastic netting or knitted synthetic fabric wrapped around the foam. One product of this type contains a plastic netting, in an embossed pattern, heat-fused to one side of the urethane foam.

Another cleaning and scouring pad known in the art is based on an abstract of British Patent No. 1,093,900 and consists of a coherent pad of random fibers in which is incorporated a resinous binder and a washing composition. The resin and soap or detergent which can be applied either together or separately are applied to the surface of the pad fibers.

All such scouring or cleaning pads known have shortcomings and disadvantages. Many of them do not contain a cleaning agent, and those that do are merely impregnated with a soap or detergent or washing composition. That is, those pads that are treated with a scouring agent have it only on the surfaces or in the interstices of the pads. Thus, the cleaning composition is easily and quickly removed from the pads. In addition, the most common steel wool pads quickly rust and deteriorate. Also, all of the products known in the art as scouring pads have harsh abrasive surfaces which can damage the surfaces of objects to be cleaned.

SUMMARY OF THE INVENTION

Objectives of the Invention and Advantages of the Products

The present invention provides means for obviating the problems, shortcomings, and disadvantages outlined above. The invention has extensive utility. Products of the invention can contain ample supplies of built-in washing compositions, or metal-polishing agents, or waxes for autos, furniture and floors, or oven-cleaner, etc. for uses in washing, polishing, or waxing a variety of objects.

An objective of this invention is to provide a cleaning pad with a supply of cleaning agent (detergent, soap, metal-polishing chemicals, etc.) housed within the pad so that when the pad is wetted with water, the cleaning compound is fed at a controlled rate and in sufficient concentration to the yarns and surface of the pad. Additional cleaning compound can be fed from its reservoir to the pad surface, if needed, by hand-squeezing the water-soaked pad. Thus, advantages of the product are that it does not waste expensive cleaning agent, but conserves it by consuming it only as needed for the job, and the new product eliminates the need for an extra container for the cleaning compound.

Another object of the invention is to provide cleaning and scouring pads in which the supply of cleaning agent can be replaced with the same or other cleaning material. Thus, an important advantage of the invention is that the pad can be used indefinitely because it is refillable.

Another objective is to produce cleaning or scouring pads from textile yarns in a tufted fabric construction, as contrasted with pads made from batts or webs or bundles of metal or plastic fibers, or from strips of plastic or plastic netting and cellulosic or plastic sponges and the like.

Another advantage of the invention and product is that a pad that becomes dirty from use is self-cleanable by its built-in detergent, merely by immersing the pad in water and squeezing it or rubbing it between hands.

Still other advantages of the invention are the following:

a. Tufted pile fabric pads can be made with one type of yarn on one surface, e.g. staple wool yarns, and another type of yarn, e.g. continuous filament nylon yarns, on the other side or surface so that the same pad can be used for different types of cleaning or scouring or scrubbing work.

b. The tufted pile surfaces of the pads can be either a loop-yarn pile or a cut pile or a loop pile can be on one side and a cut pile on the other.

c. Pads with built-in detergent can be made with a tufted yarn pile on one surface and plain woven or nonwoven fabric on the back surface and/or on the back surface can be placed a strap under which a hand is placed. Such a pad would be used for cleaning automobiles or walls of homes, etc.

d. A plastic or wooden handle can be attached to the pads containing built-in detergent and with pile yarns on both surfaces so that the pads can be used to clean toilet bowls, or walls or other areas that are difficult to reach and parts of objects that are inaccessible to cleaning with pads that are held within the palm or with fingers of a hand.

e. The tufted pile fabric construction of this invention absorbs and holds large volumes of water which combines with the built-in cleaning agent and gives long periods of cleaning after each immersion in water.

Further objectives of the invention are to produce cleaning or scouring pads, having built-in cleaning agent and yarn pile on one surface, which can be attached to electrically operated equipment, such as an electric drill or floor polisher or an electric automobile-polishing machine and the like.

These and other objects and advantages are provided by a cleaning pad which may generally be defined as a pad having an internal well for a cleaning agent which well is bound by at least one extended surface formed from a tufted textile fabric with the inner ends of the yarns forming the tufts in communication with the cleaning agent in the well, through yarn-containing openings in a plastic film separating the tufted fabric and the well.

DESCRIPTION OF THE PREFERRED EMBODIMENTS

Figure 1:
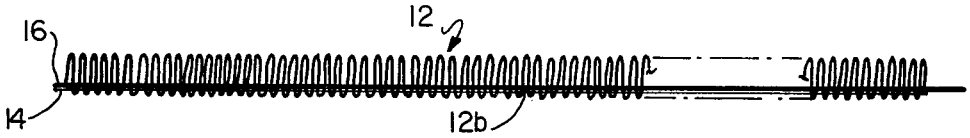
FIG. 1 is a diagrammatic view of a combined fabric piece and plastic film suitable for forming a cleaning pad constituting the invention.
Figure 2:
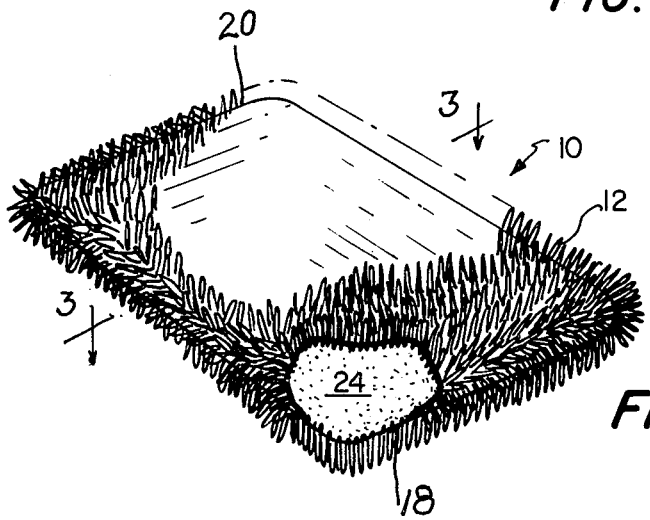
FIG. 2 is a perspective view of a pad formed from the fabric—plastic film combination shown in FIG. 1.
Figure 3:
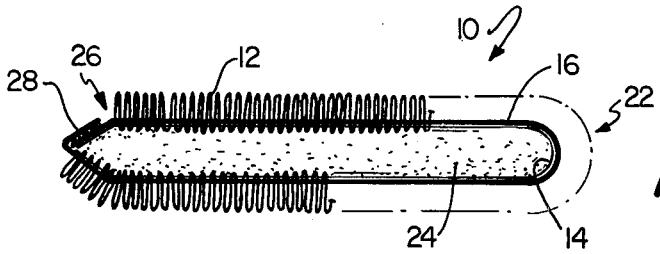
FIG. 3 is a section on line 3—3 of FIG. 2.

Referring to the drawings and in particular FIGS. 1, 2 and 3, the pads 10 of this invention are made with a tufted pile fabric 12 on at least one of their sides. Any tufting machine used to make tufted carpets or rugs or tufted upholstery or towels or a single needle hand-tufting gun can be used to make the tufted fabrics for this invention, as described in more detail below. The yarns for the tufted fabric can be from either natural or synthetic fibers or from mixtures thereof. If synthetic, the yarns can be either staple or continuous filament or both. The base material into which the yarns are tufted consists of a layer of plastic film 14 and an inexpensive fabric 16, either woven or nonwoven, and composed of cotton or jute or synthetic fibers. It is an important features of this invention that the bottom surface of the tufted fabric 12*b*, which becomes the inside surface of the cleaning pad, contains a plastic film that is impervious to water and to a solution of the cleaning or polishing compositions contained in the pad, except at the places where the yarns pass through the film and backing fabric 16. Before tufting, a thermoplastic film can be laminated to a base fabric under heat and pressure using either a set of heated pressure rollers or a flatbed press. Alternatively, a plastic film can be laid onto an inexpensive flat-woven or nonwoven fabric and yarns tufted through the two layers from the film side. This has the effect of bonding the film and base fabric together. Yarns are tufted through the film and fabric layers from the film side to form rather dense piles with a height that can be from about ¼" to about 1". The pile can be either the loop type or a cut plush type.

In making the pads 10, the tufted pile fabrics are cut into strips in widths about equal to the desired width of the pad with allowance for sealing the edges, and in lengths that are either about equal to the length of the pad or twice as long as the desired pad length. That is, if a pad is to be made with finished dimensions of 3" in width and 4½" in length, and if the same tufted pile fabric is to be used on both surfaces of the pad, then a strip of pile fabric would be cut to a width of about 3½" (to allow about ¼" on each side for edge sealing) and in a length of 9". In this case, the strip of tufted fabric is folded on itself in the length direction with the pile out and film on inside as indicated by FIG. 3. The two side edges 18 and 20 are then sealed under heat and pressure using the thermoplastic film already in place. One end of the pad is closed by the folding of the pile fabric strip onto itself as at 22. The opening between the layers of pile fabric, or the pouch 24 in the pad, is then filled through the open end 26 of the pad, with either powdered detergent, a mixture of cleaning ingredients in powder form or with flakes or a cake of soap or with a metal polishing paste or the like. The open end of the pad can then be sealed closed, or it can be fitted with a fastener as at 28 so that the end can be opened to refill the pad with cleaning agent during use and closed again.

Figure 4:
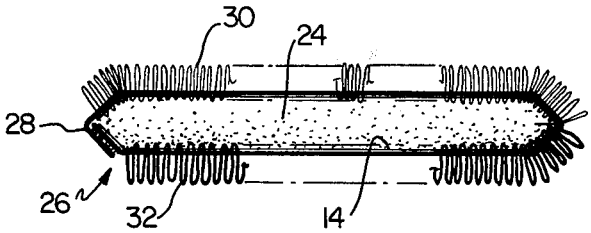
FIG. 4 is a view like FIG. 3 of a modified form of cleaning pad.

Cleaning pads can also be made by this invention with one type of tufted pile fabric 30 on one side or surface of the pad and another type of tufted pile fabric 32 on the other side, as indicated by FIG. 4. For example, side 30 of the pad can contain a dense pile of looped wool yarns in a ⅜" pile height, and the other side 32 can consist of continuous filament nylon yarns in a cut pile with a pile height of ½". In making this pad, strips are cut from the two different tufted pile fabrics with dimensions about equal to the desired length and width of the pad. These are placed one on top of the other, back to back and heat-sealed together by means of the film or sewn together at the edges along two sides and one end. A fastener 28 may be attached to the other end. The pad is then filled with cleaning agent 24 through its open end 26 and that end is then fastened together.

Figure 5:
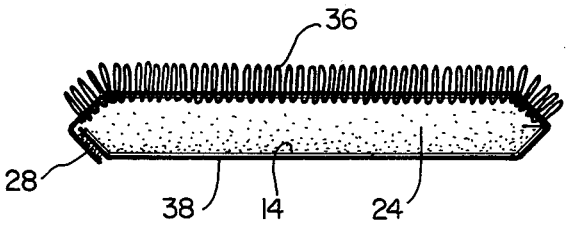
FIG. 5 is a view like FIG. 3 of a further modification.

By another embodiment of the invention, cleaning pads can be made with a tufted pile material 36 on one side and with plastic film 14 and flat woven or nonwoven fabric 38 on the other or back side of the pad as shown by FIG. 5. A wool pile pad (2½" × 3") of this type has been filled with silver polish paste and successfully and effectively used to remove the tarnish from 5 large silverplated objects including a coffee urn and water pitcher.

Figure 6:
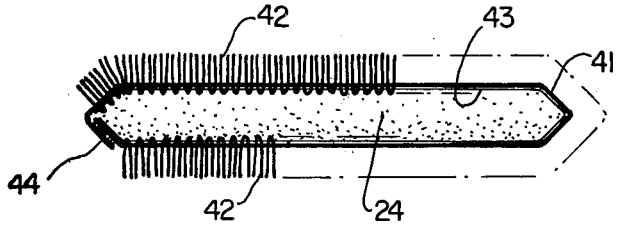
FIG. 6 is a view like FIG. 3 of another form of the present invention.

The cleaning pad shown in FIG. 6 consist of base fabric 41, cut pile 42, plastic sheet 43, well or reservoir 24 and closure means 44. This pad differs from that shown in, for example, FIGS. 2 and 3 in that the tufts are cut to form the pile.

Figure 7:
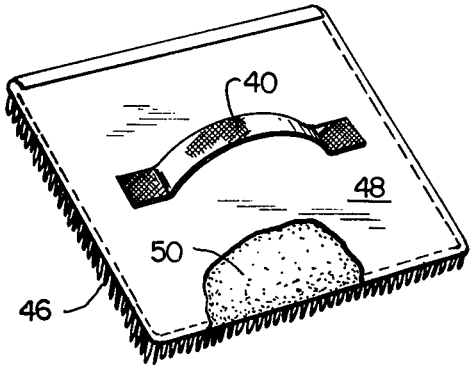
FIG. 7 is a perspective view with a portion broken away to show the internal well of a modification useful as a car washing pad.

Larger one-sided pads can be fitted on the back with a strap 40 for a hand, as shown by FIG. 7, and used for washing cars. A pad 5½" square, like that shown by FIG. 7 contained enough powdered detergent to clean three cars and there was still detergent left in the pad.

The car washing pad shown in FIG. 7 has tufted pile fabric 46 on one face only and the face containing the elastic hand strap 40 comprises a flat-woven cotton fabric 48. As in the other forms of the invention, a well 50 is included in the structures.

Figure 8:
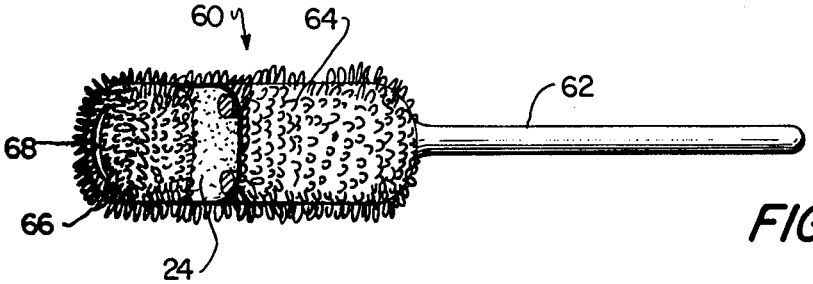
FIG. 8 is a perspective view with a portion broken away to show the internal well of a pad having a handle formed therewith.

Referring to FIG. 8, the cleaning pad 60 is provided with a handle 62, a detergent containing well 68 and ¼"

high pile 64 on one surface and ½" inch pile 66 on the opposite surface.

Figure 9:
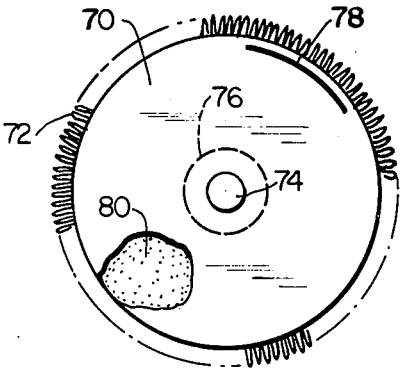
FIG. 9 is a top view of still another form of the invention with a portion broken away to show the interior well.

The floor scrubber or polisher shown in FIG. 9 has looped pile fabric 72 on one surface and flat-woven cotton fabric 70 on the opposite. The scrubber is provided with an opening 74 therethrough to receive means for attaching the scrubber to an arbor of electric drill, for example. The pad is provided with a refilling opening 78 and the well 80 is sealed as at 76 from the arbor opening 74.

Further embodiments of the invention will be apparent from the following descriptions of the tufted pile fabric variables, and of the construction features and contents of the cleaning pads, and the examples.

TUFTING MACHINES

Any tufting machine from a 1/10 to ⅜ gauge and from a 1-needle machine to a 15-feet wide broadloom carpet machine can be used to prepare the pile fabrics for the pads. The preferred and most practical machines, though, are either a 1/10 or ⅛ gauge pass tufting machine in a width of from about 5 to 12 inches. Also a hand tufting gun, either manually or electrically operated, can be employed for making strips of tufted pile fabric for the pads.

In an example, a 12" wide ⅛ gauge pass tufter was used. It had 96 needles. So 96 rows of tufted yarns, each ⅛" apart were obtained in the 12-inch wide strips of pile fabrics.

FIBER TYPES AND YARNS

The preferred natural fibers for the tufting yarns are wool and cotton. The preferred synthetic fiber yarns are either nylon, polyester, acrylic or polypropylene and they can be either staple or continuous filament yarns.

The yarns can be either singles or 2 or 3 or 4-ply. The yarn counts can range from ¼ run to about 5 run or the equivalent counts in denier. The number of yarn stitches per inch in a tufted row can be between about 3 and about 10.

Wool and cotton yarn pile structures have advantages over synthetic yarns for certain products and applications of the invention in that they absorb and hold more cleaning solution for a given surface area. The synthetic yarns have the advantage of drying faster after the pads are used. Continuous filament yarns in a loop pile construction generally wick water to the reservoir of cleaning composition and feed cleaning solution back to the yarns faster than do staple yarns. Also, continuous filament yarns in cut pile constructions are less likely to shed fibers during use of the cleaning pads than are staple yarns in cut pile constructions.

The yarns for tufting can be made from intimate blends of the natural and synthetic fibers, or separate rows of 100% natural fiber yarns and 100% synthetic fiber yarns can be tufted into the same fabric, or a different tufted pile fabric can be used on each side of the cleaning pad.

The height of the pile in the tufted pile fabrics can be from about ¼" to about 1", and preferably about ⅜".

BACKING MATERIAL FOR PILE FABRICS

The base fabric for the tufted pile fabrics can be woven or nonwoven and composed of cotton, jute, polypropylene fibers, polyester fibers or blends of two or more of those. The fabric weights can range from about 2 to 12 ounces per sq. yarn. Tightly woven 11.5 ounces/sq. yarn cotton duck fabrics, 8 to 10 ounces/sq. yard woven jute fabrics, and a 4 ounces/sq. yard woven nylon scrim have been successfully employed.

The plastic film for the primary backing of the tufted pile fabrics and the inside surfaces of the cleaning pads can be either polyethylene, polypropylene, polyvinyl chloride, or any other plastic material that is impervious to the cleaning solution. For cost and convenience, polyethylene film is preferred. The thickness of the film can be from about 2 mils to about 10 mils.

CLEANING COMPOSITION FOR PADS

The cleaning composition for the pads can be in the form of a powder, a cake or several small cakes, flakes, chips, or viscous paste.

The cleaning agent can be: soap, syntehtic detergent; mixtures of cleaning ingredients including detergent, an alkaline builder such as sodium carbonate or bicarbonate; silver-polish paste; wax paste or flakes, etc. Perfume can also be added to the cleaning agent. When natural fibers are used for the yarns of the pile the cleaning composition can contain a chemical mildewcide.

SHAPE AND DIMENSIONS OF PADS

The pads can be in the form of a parallelogram, or square, circular, oblong, etc.

The thickness of the pads may range from about ¼" to about 1", depending on the amount of cleaning agent applied and the pile height or whether sold without cleaning compound, but ready for the consumer to apply soap or detergent or a metal-polishing composition. The widths of the pads will generally range from about 2¼" to about 6½", and the lengths from about 3½" to about 6½".

FASTENERS FOR PADS

The pads can be filled with cleaning agent and sealed around all their edges and discarded when the cleaning agent is consumed. Alternatively, the pads can be finished with an opening at one end or in a small section so they can be refilled with cleaning agent. Depending on the type of cleaning agent used, it is not necessary to close the open section by means of a fastener. For example, a cake of soap can be used in the cleaning pad with an end of the pad open.

If it is desired to have a pad with an openable and closeable section for refilling it with cleaning powder or paste, any fastening arrangement known in the art can be used, including snap fasteners, zippers, plastic ziplock such as used to close polyethylene bags, and Velcro fasteners. If Velcro fasteners are employed, it may only be necessary to sew a strip of the hooked portion to an edge of the pad, because the Velcro fastener hooks will adhere to the yarns of the pile on the pad.

EXAMPLE 1 — Pad Containing Detergent

A 6 mils thick polyethylene film was laminated to the surface of a 11.4 ounces/sq. yard cotton duck fabric using a Pasadena hydraulic press with a platen temperature of 400° F., a pressure of 50 pounds per sq. inch and a 10 second dwell time. Wool yarn was tufted into the laminated material from the film side to form a pile above the cotton fabric side. The 2-ply wool yarn was 0.5 woolen run, with 5 t.p.i. of twist in the singles and 2.8 turns per inch in the ply. A tufting machine Model 8-18 was used which was made by the Tufting Machine Company, Inc. in Dalton, Geo. The machine had 96 needles and made a 12" wide tufted strip. The machine was set up to tuft: looped pile with a ⅜" pile height; 7 stitches per inch and 8 rows of tufted yarn per inch. The tufted fabric was cut to 8" × 4½". This was then folded in half to make approximately a 4" × 4½" pad with pile on both sides and the polyethylene film inside of the pad by applying heat and pressure to the side edges with a small hand iron. The pouch of the pad was filled through the open end with 10 grams of sodium carbonate soap, perfume, and mildewcide. The open end was then sealed shut. This pad was used to clean cookware and dishes, kitchen bench top, etc. Upon wetting the pad, the detergent in solution form came out gradually into the yarns and one pad was very effective for over a month's use.

EXAMPLE 2 — Refillable Pad Containing Detergent

Like No. 1 but after laminating the two side edges together to make a pouch, the final side was not laminated shut but had an openable and closeable fastener attached to it. A Velcro fastener was attached by sewing a strip containing hooks to the one top edge and a strip having loops to the other top edge of the pad so that more detergent could be put into the pad and closed when the pad became empty of detergent.

EXAMPLE 3 — Pad Containing Silver-Cleaner Polish

An open-weave nylon scrim (4 ounces/sq. yard, 14 × 14 yarns/inch) and a 3 mils thick polyethylene film were placed tightly on a tenter frame for tufting into it with a hand held "Cobble" electric tufting gun. The scrim and film were not laminated together under heat and pressure as in Examples 1 and 2, but locked together by tufting through the film side forming pile on the nylon scrim side. Wood yarn (0.5 Woolen run 5 t.p.i. in singles and 2.8 turns per inch in ply) was tufted into a 4" wide pile fabric. The gun was set up to tuft ⅜" thick pile, 8 stitches per inch and the operator tufted 7 rows in an inch. A 4" × 4" piece of the tufted wool pile fabric was laminated along 3 edges to a 11.4 ounces/sq. yard cotton duck fabric (4" × 4") using the 3 mils thick polyethylene film as the bonding medium. A heated hand-iron was used by applying pressure to the edges for seconds. The remaining open end was used to fill the pad with 15 grams of silver polish paste. That end of the pad was then sealed in the manner that the other three sides were. This pad was used to remove tarnish from silver objects in a home. Five large objects, including a 25-cup coffee urn, and a water pitcher were polished with one pad and there was cleaning agent left in the pad.

EXAMPLE 4 — Car Washing Pad with Refillable Pouch for Detergent

A 4 mils thick polyethylene film was placed on top of a 11.4 ounces/sq. yard cotton duck fabric and nylon yarns was tufted into the film and fabric through the film side. The nylon yarn used was a 6500 denier with 2 t.p.i. of twist which had been 4-plyed from DuPont Antron yarns of 1225 denier, 80 filament per yarn. A tufting machine, Model 8–18 was used which was made by the Tufting Machine Company, Inc. in Dalton, Geo. The machine had 96 needles and made a 12" wide tufted strip. The machine was set up to tuft a ⅜" high looped pile, containing 7 stitches per inch and 8 rows of tufting per inch. The 12" wide tufted fabric was cut down the middle lengthwise, making 2–6" wide tufted pile pieces. The cotton fabric and film base material was allowed to extend over one end of the pad for use as a closure. The pile was cut in 6" lengths so the entire cut piece measured 6" × 7" with 6" × 6" being pile and the other 1" on one side being extending cotton and film backing. The back portion of the pad consisted of a 6" × 6" piece of cotton duck fabric 11.4 ounces/sq. yard and 4 mils thick film. The polyethylene film was used as the inside surface of the pouch. The sandwiched materials were then laminated together around the 3 edges using the polyethylene film already on the inside of the pad by applying heat and pressure with a hand-iron. A Velcro fastener was sewn to the open edges of the pouch. This allowed detergent to be added whenever it was needed. A 2" wide piece, 6" long of woven elastic was put across the cotton back side of the pad, as shown by FIG. 7, to permit easy use for car washing. The cleaning pad, containing the detergent was used in conjunction with a water hose and it was effective in removing dirt, grease and oil from the surfaces of 3 cars without adding fresh detergent.

EXAMPLE 5 — A Pad with a Different Pile on Each Side for Bathing

A 4.0 ounces/sq. yard nylon scrim (14 × 14 yarns/inch) and a 4 mils thick polyethylene film were placed tightly on a tenter frame as the base for tufting with a hand-held "Cobble" electric tufting gun. Yarns were tufted through the film side to form pile on the scrim side. A three and one half inch wide strip was tufted with nylon yarn and another strip with wool yarn. The nylon was 4-ply 6500 denier, 2 t.p.i. and the wool was the 2-ply, 0.5 run. The tufting gun was set up to tuft ⅜" high pile, 8 stitches per inch and the operator tufted 7 rows per inch. On both sides of the 3½" wide tufted strips was left a 1" width of the untufted scrim and film base material. This was later used for a seam allowance and a place for the attachment of the fastener. Six inch lengths were cut from each of the two different pile fabrics. A pad with a pouch in the center was made by placing one fabric piece on top of the other and sewing them together along 3 edges. A Velcro fastener was attached to the open end. A cake of soap was placed inside the pad. The pad was used as a personal wash cloth with built-in soap. During use, the yarns of the pile were very sudsy. An advantage of the pad is that it uses the soap efficiently. Also no soap is wasted, because small pieces of soap that are normally thrown away can be put into the pad.

I claim:

1. A cleaning pad with an internal well for cleaning agent, said pad characterized in that at least one external surface thereof is formed from a fabric and a cleaning agent impervious plastic film, yarn tufts penetrating said fabric and said plastic film, and the inner ends of the yarns forming the tufts of the tufted fabric communicating with cleaning agent in the internal well, solely through yarn-containing openings in said plastic film.

2. A cleaning pad as defined in claim 1 further characterized in that an opening is provided along one edge of the pad for inserting a cleaning agent in the internal well and means for sealing said opening.

3. A cleaning pad as defined in claim 1 further characterized in that all external surfaces thereof are formed from a tufted textile fabric.

4. The cleaning pad as defined in claim 3 wherein at least two of the external surfaces of the pad are formed from different tufted textile yarns.

5. The cleaning pad defined in claim 4 wherein one of the tufted pile surfaces comprises looped-yarn pile and another surface comprises a cut pile.

6. The cleaning pad defined in claim 1 wherein another external surface thereof comprises a non-tufted fabric.

7. A cleaning pad as defined in claim 1 including an elongated handle attached to the pad.

8. A cleaning pad as defined in claim 1 further characterized in that one external surface is provided with a hand engaging strap.

* * * * *